United States Patent [19]

Bishop

[11] 3,963,160

[45] June 15, 1976

[54] APPARATUS FOR PERFORMING TWO OR MORE OPERATIONS ON A CONTINUOUS WEB IN A SINGLE PASS

[75] Inventor: Thomas Desmond Bishop, Solihull, England

[73] Assignee: The Deritend Engineering Company Limited, Birmingham, England

[22] Filed: Nov. 12, 1974

[21] Appl. No.: 523,239

[30] Foreign Application Priority Data

Dec. 12, 1973 United Kingdom ..... 57470/73

[52] U.S. Cl. ..... 226/115; 101/227

[51] Int. Cl.[2] ..... B65H 17/42

[58] Field of Search ..... 226/108, 111, 115, 117, 226/50; 101/226, 227

[56] References Cited

UNITED STATES PATENTS

| | | | |
|---|---|---|---|
| 1,324,169 | 12/1919 | Phillips | 223/52.6 |
| 1,910,359 | 5/1933 | Paulsen | 101/227 |
| 2,963,965 | 12/1960 | Baumgartner | 101/227 |

*Primary Examiner*—Allen N. Knowles
*Attorney, Agent, or Firm*—Marshall & Yeasting

[57] ABSTRACT

The invention provides apparatus for producing printed and cut blanks from continuous webs of cardboard or the like, which avoids wastage between successive blanks when the length of the blank is not equal to the periphery of the treatment rolls of the apparatus by using two coupled accelerators which adjust the position of the web after each complete operation.

4 Claims, 1 Drawing Figure

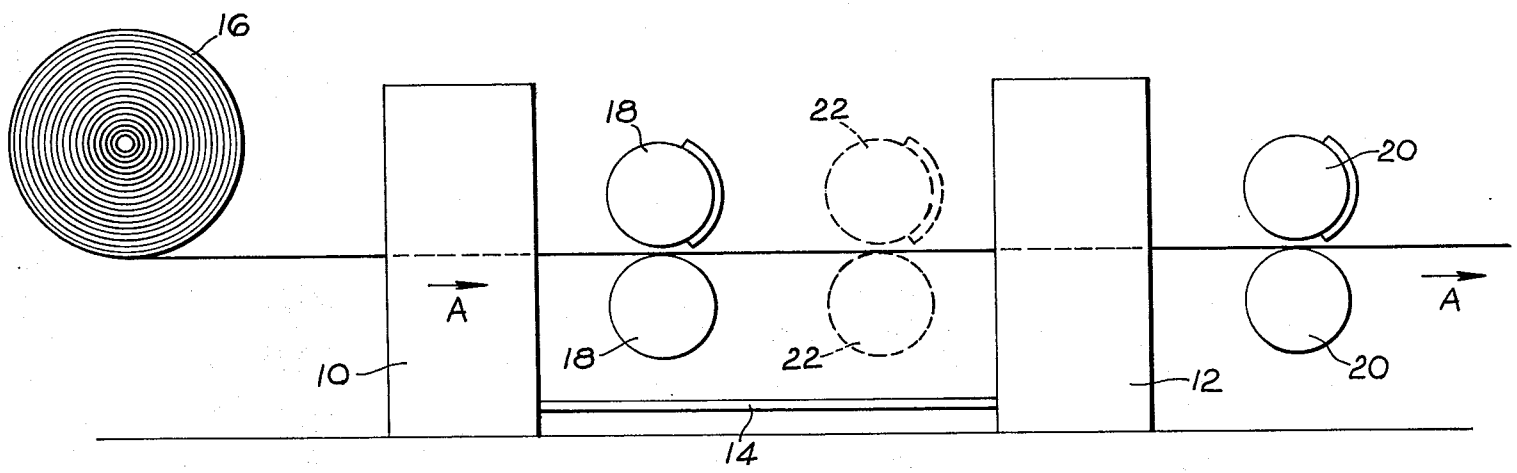
16
10
A
18
18
14
22
22
A
20
20
12

APPARATUS FOR PERFORMING TWO OR MORE OPERATIONS ON A CONTINUOUS WEB IN A SINGLE PASS

BACKGROUND OF THE INVENTION

This invention relates to the treatment of web material for example in the manufacture of cardboard boxes.

It has previously been proposed for example in my U.S. Pat. No. 3,756,149, corresponding to British Pat. No. 1,324,169 to provide web treatment apparatus comprising a continuously rotatable rotary member having a part-circumferentially extending web treatment area, a first counter pressure member co-operable with said web treatment area to effect feed of the web therebetween during a part of each revolution of the rotary member, a drive element and a second counter pressure member associated therewith, and variable drive transmission means comprising cam means rotatably fast with said rotary member and a cam follower co-operable with the cam profile of said cam means to transmit rotational drive to said drive element in such a way that, during each revolution of the rotary member, said drive element is accelerated in the same rotational sense as the rotary member immediately prior to feed of the web by said rotary member the first counter pressure member, is decelerated in said same rotational sense immediately subsequent to termination of feed of the web by the rotary member and the first counter pressure member to arrest feed movement of the web, and is accelerated and then decelerated in the opposite rotational sense during the remainder of each revolution of said rotary member to effect reverse feed of the web, the second counter pressure member being co-operable with said drive element during such acceleration and deceleration of the latter to impart feed movement to the web and said cam means comprising a pair of cam parts which are adjustable relative to one another to vary the cam profile.

In such apparatus the web is fed forwardly at the same linear speed as the periphery of the treatment apparatus area, that is the forme of the printer or die-cutter, during the time that the latter co-operates with the said first counter pressure member to effect the printing or die-cutting without slip between the web and forme, and then after the conclusion of that treatment the web is reversed before being fed forwardly again. It is necessary to slow and stop the web before reversing and slow and stop the reverse movement before beginning the forward feed, and to accelerate the web in the forward direction, so that after completion of one cycle the web is again travelling at the correct speed. Moreover, the values of the intermediate steps, between completion of one printing or die-cutting operation and commencement of the next are such, in relation to the other parameters such as the length of the forme, that there is a minimum gap or no gap between such two successive treated areas of the web.

In practice the said apparatus may be used for either printing a web, which is then re-rolled, or for die-cutting to produce a series of cut blanks which are stacked. It has not been possible to effect both printing and die-cutting. The object of the invention is to enable two or more operations such as two-colour printing, or ( and more particularly ) printing and die-cutting to be effected in a single pass through an apparatus.

SUMMARY OF THE INVENTION

In accordance with the present invention, we provide first and second spaced feed means which are coupled together to operate in synchronism for feeding a web forwardly and in reverse, a number of treatment rolls located between the two sets of feed means and a further number of treatment rolls located beyond the second set of feed means.

Preferably each of the feed means is generally as described in prior U.S. Pat. No. 3,756,149, and they may be coupled together by a propshaft or other synchronising means.

It is preferred to provide for printing between the two sets of feed means, and where multi-coloured printing is required, a multiple of sets of printing rolls for example flexographic printers may be provided. All these are arranged to operate effectively simultaneously on the web at the time when the latter is moving in the correct sense at the correct speed, and to be out of engagement with the web when the latter is decelerated and reversed, and during its forward acceleration before reaching its treatment speed. It may be necessary to provide spaces between successive sets of printing rolls to allow for drying, and if required fixed loops may be formed in the web for this purpose.

It is also preferred to provide for die-cutting immediately after the second set of feed means.

The second set of feed means may be geared slightly higher than the first set of feed means so as to maintain the web therebetween under slight tension.

By these means, printed and die cut blanks may be produced in a single pass.

BRIEF DESCRIPTION OF THE DRAWINGS

The drawing is a diagrammatic elevational view of a preferred form of apparatus embodying the invention

DESCRIPTION OF THE PREFERRED EMBODIMENTS

Referring now to the drawing, the apparatus comprises two separate accelerator means 10, 12, each of which is constructed as described in U.S. Pat. No. 3,756,149, these two accelerators being coupled by propshaft 14 so as to be driven in synchronism.

A reel of web 16, for example cardboard, is supported so as to feed the web in the direction of the arrows A so as to pass through the two means and via a printing roll set 18 located between the two, and subsequently through a die-cutter roll set 20 located by the second accelerator 12.

The operation of the accelerator means is to feed the portion of the web, for example lying between the two arrows A forwardly, at the same peripheral speed as that of the various treatment rolls, for simultaneous operation of the printing means and the die-cutting means, and after those operations have been completed, to adjust the position of the web so that it is again travelling forwardly at the correct speed at the time when the first untreated portions of the web are about to be acted upon by the respective treatment means.

Where two colour printing is required, the second set of printing means 22, shown in broken lines in the drawing, will also be located between the two accelerators and arranged to operate simultaneously with the other treatment means.

I claim:

1. Apparatus for treating web material comprising first and second pairs of treatment rolls, said pairs being spaced apart in the direction of travel of the web, each treatment roll pair including one roll having a treatment area which extends over only part of the circumference of the roll and serves, when in confronting relation to the other roll of the pair, to provide a nip by means of which the web is driven forwardly while it is contacted by the treatment area, said roll pairs being synchronized so that their treatment areas contact the web simultaneously, a first feed mechanism located adjacent to the entering side of the first roll pair, a second feed mechanism located adjacent to the entering side of the succeeding roll pair, each feed mechanism constituting means for decelerating the web upon each cessation of contact between the web and said treatment areas, moving the web in the reverse direction, and then accelerating it in the forward direction to synchronize the speed of the web with the linear speed of said treatment areas, and means for synchronizing the operation of said feed mechanisms to cause them to move bodily and maintain under tension the entire span of the web between said feed mechanisms.

2. Apparatus according to claim 1 wherein said first pair of rolls are printing rolls and said succeeding pair of rolls are die-cutting rolls.

3. Apparatus according to claim 1 wherein the first and second feed mechanisms are coupled by a propshaft to synchronize their operation.

4. Apparatus according to claim 1 comprising an additional treatment roll pair arranged to operate upon the web after said first roll pair and before said succeeding roll pair.

* * * * *